US010295167B2

(12) United States Patent
Xiang

(10) Patent No.: US 10,295,167 B2
(45) Date of Patent: May 21, 2019

(54) COOLING MECHANISM FOR LED LIGHT USING 3-D PHASE CHANGE HEAT TRANSFER

(71) Applicant: Xiaodong Xiang, Danville, CA (US)

(72) Inventor: Xiaodong Xiang, Danville, CA (US)

( * ) Notice: Subject to any disclaimer, the term of this patent is extended or adjusted under 35 U.S.C. 154(b) by 537 days.

(21) Appl. No.: 14/786,543

(22) PCT Filed: Apr. 24, 2014

(86) PCT No.: PCT/US2014/035371
§ 371 (c)(1),
(2) Date: Oct. 22, 2015

(87) PCT Pub. No.: WO2014/176465
PCT Pub. Date: Oct. 30, 2014

(65) Prior Publication Data

US 2016/0102854 A1 Apr. 14, 2016

Related U.S. Application Data

(60) Provisional application No. 61/854,428, filed on Apr. 24, 2013.

(51) Int. Cl.
*F21V 29/00* (2015.01)
*F21V 29/71* (2015.01)
(Continued)

(52) U.S. Cl.
CPC ..... *F21V 29/71* (2015.01); *F21K 9/232* (2016.08); *F21K 9/238* (2016.08); *F21V 23/003* (2013.01);
(Continued)

(58) Field of Classification Search
CPC ..... F21V 29/76; F21V 29/71
(Continued)

(56) References Cited

U.S. PATENT DOCUMENTS 5,865,244 A * 2/1999 Moser ..... B29C 45/14614 165/173
7,628,512 B2 12/2009 Netzel et al.
(Continued)

OTHER PUBLICATIONS

International Search Report in the parent PCT application No. PCT/U52014/035371, dated Aug. 22, 2014.
(Continued)

*Primary Examiner* — Gerald J Sufleta, II
(74) *Attorney, Agent, or Firm* — Chen Yoshimura LLP

(57) ABSTRACT

Novel 3-D super-thermal conducting heat management design and delayed cooling using phase change materials are adopted to lower the temperature inside LEDs and other devices. The cooling mechanism uses a fin structure with hollow fins to dissipate heat to the environment. The hollow space inside the fins is connected to an interior chamber, where a liquid to vapor phase change material (L-V PCM) is provided to transfer heat from the LED chips to the surface of the hollow fins. The LED chips are mounted on an evaporator located at the bottom of the chamber. A liquid reservoir is provided, and the evaporator surface is hydrophilic with an additional wick structure to transport the L-V PCM liquid to the evaporator surface. The fins are parallel to each other and are either parallel or perpendicular to the evaporator surface. This structure has superior performance and is inexpensive to manufacture.

9 Claims, 10 Drawing Sheets

(51) Int. Cl.

| | |
|---|---|
| ***F21V 29/76*** | (2015.01) |
| ***F21V 29/51*** | (2015.01) |
| ***F21V 23/00*** | (2015.01) |
| ***F21V 23/06*** | (2006.01) |
| ***F21K 9/232*** | (2016.01) |
| ***F21K 9/238*** | (2016.01) |
| *F21V 3/00* | (2015.01) |
| *F21Y 115/10* | (2016.01) |

(52) U.S. Cl.
CPC ..... *F21V 23/06* (2013.01); *F21V 29/006* (2013.01); *F21V 29/51* (2015.01); *F21V 29/76* (2015.01); *F21V 29/767* (2015.01); *F21V 3/00* (2013.01); *F21Y 2115/10* (2016.08)

(58) Field of Classification Search
USPC ..... 165/104.19, 104.21, 104.22, 104.26, 165/104.27, 104.28, 104.32, 104.33, 80.4
See application file for complete search history.

(56) References Cited

U.S. PATENT DOCUMENTS

2007/0159833 A1* 7/2007 Netzel, Sr. ..... F21S 8/00 362/373
2010/0263842 A1* 10/2010 Ast ..... F01K 25/08 165/133
2011/0026251 A1* 2/2011 Liu ..... F21V 29/004 362/249.02
2011/0043092 A1* 2/2011 Shuja ..... F21V 29/006 313/46
2012/0026745 A1* 2/2012 Cheng ..... F21S 48/328 362/373
2013/0186596 A1* 7/2013 Rubenstein ..... G06F 1/206 165/104.17
2014/0160762 A1* 6/2014 Dudik ..... G02B 5/0242 362/294

OTHER PUBLICATIONS

IPRP in the parent PCT application No. PCT/US2014/035371 dated Oct. 27, 2015.
Kim et al., "Thermal analysis of LED array system with heat pipe", Thermochimica Acta, vol. 455, 2007, pp. 21-25.
Huang et al., "Experimental Investigation of Vapor Chamber Module Applied to High-Power Light-Emitting Diodes", Experimental Heat Transfer, 22:26-38, 2009.
Ye et al., "A review of passive thermal management of LED module", Journal of Semiconductors, vol. 32, No. 1, pp. 014008-1-014008-4, Jan. 2011.

* cited by examiner

COOLING MECHANISM FOR LED LIGHT USING 3-D PHASE CHANGE HEAT TRANSFER

FIELD OF THE INVENTION

The present invention relates to light emitting diodes (LEDs) and other high power density devices such as laser and computer chips. In particular, it relates to a cooling mechanism for LED lights.

BACKGROUND OF THE INVENTION

Although light emitting diodes (LEDs) hold great promise for application ranging from telecommunications to general illumination, the cost per-lumen still hinders LED's penetration of the markets. Currently, the lighting market is dominated by compact fluorescent lamp (CFL). The cost per-lumen for LED luminaires must rapidly decreases to compete with CFLs.

One way to realize the price-reduction objectives for LED lights without significantly changing the device manufacturing cost is to increase the injection current density, for example by a factor of 2 to 4, from an order of tens of $A/cm^2$ to hundreds of $A/cm^2$. However, increasing the light-power output of devices through increasing the drive-current of LEDs could lead to two problems due to increased heat generation. One is the effect of "efficiency droop" and the other one is the effect of "thermal runaway". If the heat cannot be dissipated properly, the higher junction temperature will lead to lower EQE (external quantum efficiency) of the LED device, which will lead to an even higher temperature and eventually lead the LED devices to thermal failure. Therefore, the thermal management of the LEDs is a key issue to decreasing the cost of LED lights without significantly changing the manufacturing cost of LED chips. Additionally, keeping the junction temperature as low as possible is also beneficial to the lifetime of LEDs. In summary, LED thermal management is critical to lowering junction temperature, increasing light power output and lifetime.

Heat transfer process follows the following rule:

$$Q=hA\Delta T$$

where Q is the heat transfer power (W), h is the heat transfer coefficient ($W/(m^2 \cdot K)$), A is the area of thermal pass, and $\Delta T$ is the temperature gradient or difference. The heat transfer coefficients of different heat transfer mechanisms are different. Because of the considerable difference of h between different heat transfer mechanisms, it is necessary to evenly spread the heat to different thermal pass area to achieve an effective cooling system.

The thermal model of a common LED system is depicted in FIG. 1. The system thermal resistance of the LED device can be divided into three categories or stages: $R_{inner}$, $R_{inter}$, and $R_{exter}$. $R_{inner}$ includes the thermal resistance of the LED chip ($R_{chip}$), the thermal resistance of the sub-mount bonding ($R_{bonding}$), and the thermal resistance of the substance of the substrate and back solder. $R_{inner}$ is mainly determined by the chip design and the materials used in fabricating the chip. $R_{inter}$ refers to the thermal resistance derived from the printed circuit board (PCB) and thermal interface materials (TIM). $R_{exter}$ relates to the thermal resistance from the TIM to the atmosphere.

FIG. 3 shows a LED light structure employing a conventional cooling mechanism to dissipate heat from the LED chips to the environment. The LED chips 301, along with necessary PCB and TIM, are mounted on a surface of a cooling fin structure 303 and enclosed in a cover 302. The fin structure 303 is formed of multiple solid plates made of metal. The LED light also has a connector 305 for affixing it to a conventional lighting fixture, and a power unit 304 containing circuitry for driving the LED chips.

Comparing with the typical values of $R_{inner}$ and $R_{inter}$, $R_{exter}$ based on passive heat sink according to conventional technologies often cannot satisfy the application demands for LEDs driven by high injection currents. The thermal resistance of passive heat sink is caused by its poor heat match or spreading. Phase change cooling systems, which conduct heat away through phase change at a high temperature region and reverse phase change at a low temperature region, can improve the heat spreading significantly.

1-D heat pipe and 2-D vapor chamber are two widely used phase change cooling systems. Both of them have been applied in thermal management of LEDs, for example, as described in Lan Kim et al., Thermal analysis of LED array system with heat pipe, *Thermochimica Acta,* 455, 21-25 (2007) ("Kim et al. 2007"); and H.-S. Huang et al., Experimental Investigation of Vapor Chamber Module Applied to High-Power Light-Emitting Diodes, *Experimental Heat Transfer,* 22, 26 (2009) ("Huang et al. 2009"). In such systems, the heat pipe and vapor chamber function as a heat spreader between the heat source and the lower temperature region. As shown in FIG. 2, the heat pipe and vapor chamber still need to be coupled with heat sink in actual application. A heat pipe spreads the heat from a heat source to a heat sink through a one-dimensional phase change heat transfer structure (See FIG. 2(*a*)). The typical thermal resistance of a heat pipe coupled with a heat sink is about 5 K/W (see Kim et al. 2007). A vapor chamber spreads the heat through a two-dimension phase change heat transfer structure (See FIG. 1(*b*)). The typical thermal resistance of a 2-D vapor chamber coupled with a heat sink is 3.2-4.9 K/W (see Huang et al. 2009).

SUMMARY OF THE INVENTION

The natural air convective heat transfer coefficient between a heat sink and the environmental atmosphere is typically 5 to 25 $W/(m^2K)$ while the heat transfer coefficient of phase change process is in the order of tens of thousands $W/(m^2K)$. This means that the heat spreader needs to transfer the heat from the heat source to a heat sink of $10^4$-$10^5$ times the area of the heat source if natural air convective cooling is used to cool the heat sink. Therefore, a major bottleneck of the cooling system for high power LEDs is the insufficient heat transfer area between heat sink and atmospheric environment. The required heat sink surface areas ($A_{hs}$) to realize the target light-power output for various types of LED chips, such as current commercial chips, advanced MQW chips, advanced DH chips, etc., and at various output powers can be calculated. For example, for a 60 W-equivalent replacement LED luminaire, the required heat sink surface areas are on the order of a thousand $cm^2$ using the assumptions as follows: natural air convective heat transfer coefficient is 10 $W/(m^2K)$, and the temperature difference between the heat sink and atmospheric environments is 10 K. Additionally, the required large surface area and thickness of solid heat sink also increases the cost of luminaires. For example, a typical cost of solid heat sink for high power electronics devices can be in the range of 0.5-10 dollars. If heat pipes (1-D or 2-D) are used in the cooling system, the cost of the cooling system may increase dramatically to 15-100 dollars (see Huaiyu Ye et al., A review of passive thermal management of LED module, *J. Semicond.,* 32, 014008 (2011)). The cost at this level is not practical in the luminaire applications.

As discussed above, the heat spreader in an LED cooling system needs to transfer the heat from the chip to a $10^4$-$10^5$ times larger area. If the thermal match is carried out by the present 1-D heat pipe or 2-D vapor chamber, the cost burden will be too heavy to apply in luminaires. Therefore, these cooling systems based on heat pipe or vapor chamber need a secondary active cooling system in addition to the heat sink because of its insufficient heat spreading. Otherwise, there will be a temperature difference between the top of the heat sink and the environment ranging from tens to one hundred Ks.

To summarize, the inventors of the present invention realized that to keep junction temperature low when the LED device is driven by a high forward current, the system level thermal resistance of packaged LED luminaires needs to be reduced as far as possible, and that $R_{exter}$ is the major bottleneck in the thermal management of LED luminaires. Therefore, a luminaire-level advanced cooling strategy is need for the LED luminaires with higher powers. As explained above, the key point in developing the advanced cooling strategy is how to spread the heat from a relatively small heat pass area (approximately 1 $mm^2$) to a much bigger one (approximately 0.1 $m^2$).

This invention is intended to provide an effective heat spreading strategy for thermal management in LED luminaires to enhance its light power output and life span performance while reducing the cost of the cooling system for high power LED luminaires significantly. Furthermore, this invention can be applied to other similar high power density devices, including computer main engine chips, laser diodes, etc.

A novel 3-D "phase change heat exchange" structure is used to dissipate heat from the high power LED chips and other high power density devices to the atmosphere.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a light emitting diode (LED) light which includes: an enclosure structure defining a chamber, wherein the enclosure structure includes a plurality of hollow fins disposed substantially in parallel with each other, each fin enclosing a hollow space which is connected to the chamber, the hollow spaces and the chamber forming a sealed space, wherein a flat part of the enclosure structure forms an evaporator, a plurality of LED chips mounted on the evaporator and in thermal contact with the evaporator; and a liquid to vapor phase change material (L-V PCM) disposed inside the chamber.

DETAILED DESCRIPTION OF THE PREFERRED EMBODIMENTS

Figure 1:
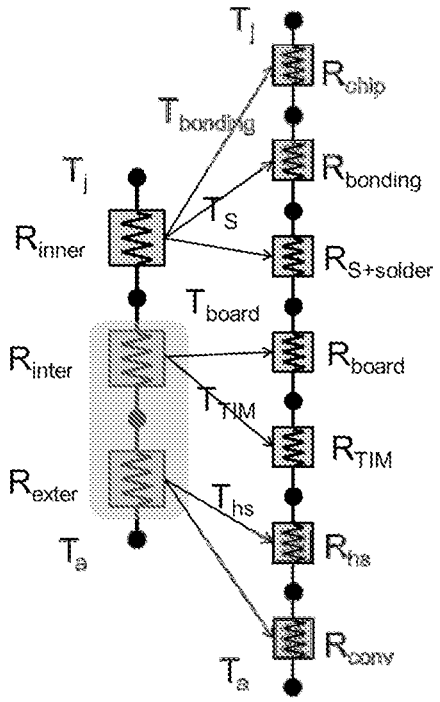
FIG. 1 schematically illustrates a typical thermal model of LED luminaires.
Figure 2:
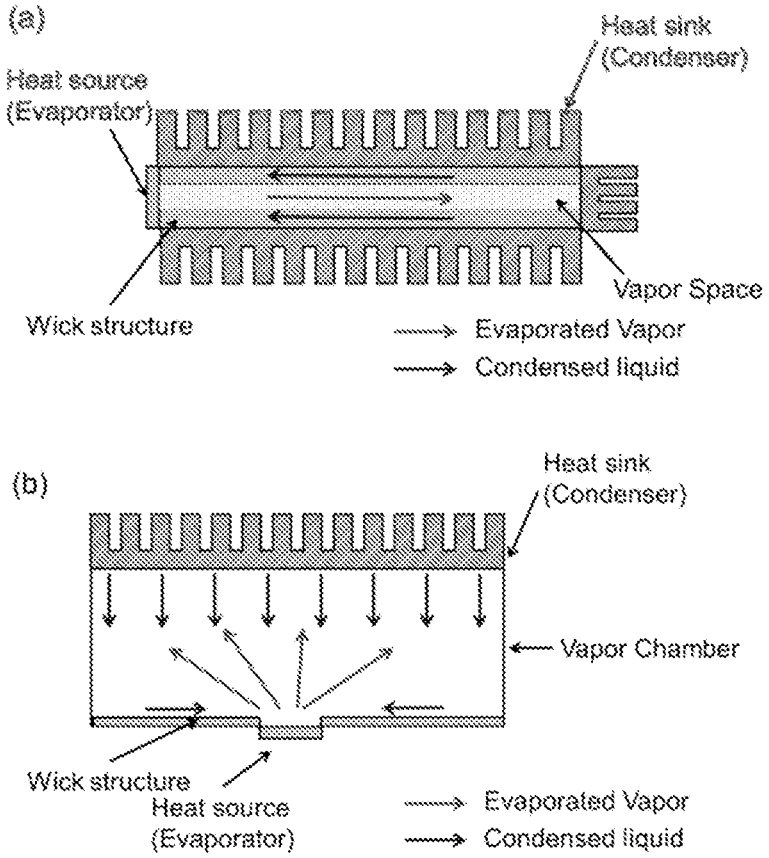
Fig. 2 (prior art)
FIG. 2 schematically illustrates an LED cooling system using a heat pipe and a vapor chamber.

It is understood that the examples and embodiments described herein are for illustrative purposes only and that various modifications or changes in light thereof will be suggested to persons skilled in the art and are to be included within the spirit and purview of this application and scope of the appended claims.

In embodiments of the present invention, the LED luminaire employs a fin structure with hollow fins to dissipate heat to the environment. The hollow space inside the fins is connected to a chamber, where a liquid to vapor phase change material (L-V PCM) is provided to transfer heat from the LED chips to the surfaces of the fins.

In some embodiments, LED chips are mounted on different evaporators, including chip-area evaporators and mounting and thermal block evaporators. Chip-area evaporators use the back surface of chips mosaicked in a mounting block as the evaporator surface. Mounting and thermal block evaporators are made of a copper sheet with a thickness of about 1-5 mm and the LED chips are mounted on the copper sheet. The copper sheet spread the heat from a chip area (about 1 $mm^2$) to a relatively larger area (about 1 to 2 $cm^2$). Both of these two kinds of evaporator surface are treated to be a hydrophilic surface. The evaporator with LED chips is packaged in a 3-D vacuum-sealed enclosure which forms a chamber. The sealed chamber can have a high vacuum, medium vacuum, or low vacuum.

In all embodiments, a liquid to vapor phase change materials (L-V PCMs) with a desired boiling temperatures (e.g., room temperature to 100° C.) is used to wet the evaporator surfaces during LED luminaire operation. The L-V PCM may be stored in a reservoir integrated with the 3-D enclosure. Additional wick structure or fiber materials can also be implemented to use capillary force effect to transport the L-V PCM from the reservoir to the evaporator surface. The hydrophilic surface of the evaporator spreads L-V PCM uniformly to keep the surface wet. During the high power LED chip operation, as the evaporator surface temperature rises, which can exceed the boiling temperature of the liquid, the L-V PCM liquid layer evaporates and carries away the heat from the evaporator surfaces. The heat carried by the vapor is transferred to the cold surfaces of the 3-D enclosure and the vapor condensed back into the liquid. The liquid then is transferred back to the L-V PCM reservoir or the evaporator surface by gravitational force or other methods to continue the cycle.

In some embodiments, the cold surfaces are the surfaces of containers which contain a solid to liquid PCM (S-L PCM) with a melting temperature slightly lower than the desired maximum operating temperature of the LED chips. The S-L PCM containers are packaged in the chamber or another 3-D enclosure with their surfaces spaced away from each other with small gaps. The surfaces of the S-L PCM container can be coated with a hydrophobic thin film to increase heat exchange coefficient of vapor to liquid phase change. The S-L PCM containers can have a geometry of flat plate or cylindrical shape, preferably with a thin thickness or small diameter. In this way, the evaporator surface and the S-L PCM container surfaces are thermally "short circuited" with negligible temperature difference. The heat on the evaporator surface is then transferred on the surface of the S-L PCM containers and thermally stored in the S-L PCM materials as the S-L PCM materials melt into a liquid. After the LED luminaire is turned off, the heat stored in S-L PCM is dissipated into the environment by natural air convection.

Figure 4:
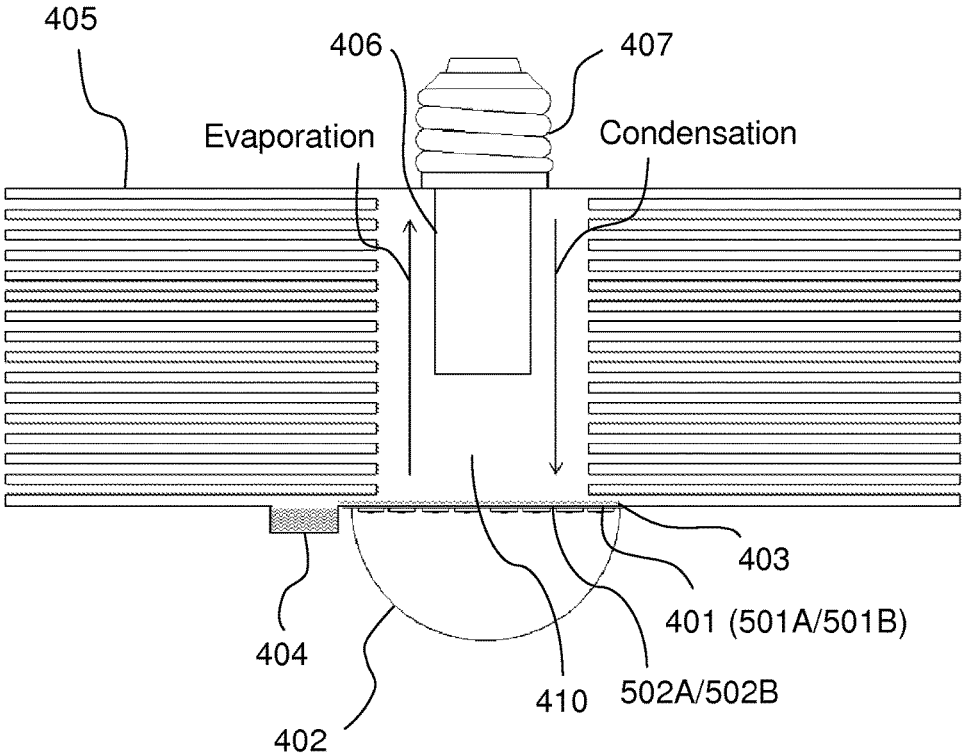
FIG. 4 is a schematic illustration of an LED luminaire with a cooling structure according to a first embodiment or the present invention.

An LED light according to a first embodiment of the present invention is illustrated in FIG. 4 (schematic cross-sectional view). A hollow fin structure 405 is used to dissipate heat to the environment. The exterior shapes of the fins are flat plates arranged substantially parallel to each other, but each fin is hollow inside, and the hollow space of each fin is in fluid/vapor communication with an interior space (chamber) 410 of the LED light. The fin structure 405, also referred to as a 3-D enclosure, may be formed of thin metal sheets that enclose the hollow space. The hollow space inside each fin is a thin and wide space, for example up to a few mm thick. The chamber 410 and the hollow space inside the fins 405 form a sealed space, and an L-V PCM 403 is provided inside. The L-V PCM has a boiling temperature suitable for the operating temperature range of the LED light. Examples of materials that can be used as the L-V PCM include water, certain alcohols, etc.

A number of LED chips 401 are located at the bottom end of the chamber 410. The chips 401 may be used as chip-area evaporators, shown in detail in FIG. 5A. In this structure, the LED chips 501A are mounted in the openings of a mounting block 502A which is about 1 to 5 mm thick. The back surfaces of the chips 501A and mounting block 502A, which are exposed to the interior of the chamber 410, may be treated to be hydrophilic to keep them wet during operation. The back surfaces of the chips 501A (about 1 $mm^2$ in size each) act as evaporators for phase change heat transfer.

Figure 5A:
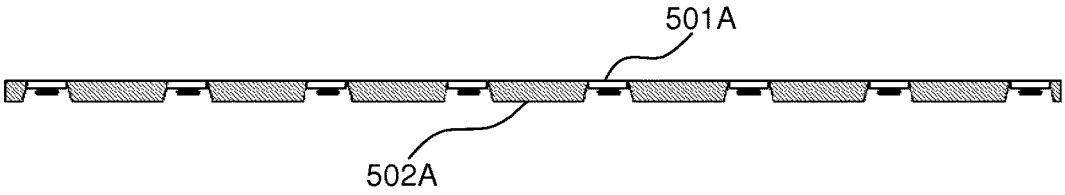
FIG. 5A schematically illustrates a chip-area evaporator of an LED luminaire that can be used with the cooling structure of various embodiments of the present invention.
Figure 5B:
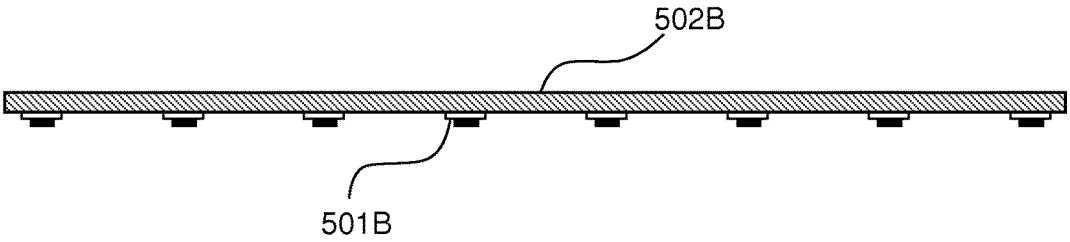
FIG. 5B schematically illustrates a thermal block-area evaporator of an LED luminaire that can be used with the cooling structure of embodiments of the present invention.

Alternatively, as shown in FIG. 5B, the LED chips 501B may be mounted on the underside of a mounting and thermal block 502B, which has its upper side exposed to the interior of the chamber 410 and acts as an evaporator. Comparing with the evaporator shown in FIG. 5A, the thermal block-area evaporator of FIG. 5B has a larger evaporating surface which leads to a relatively low thermal power density on the surface of the evaporator. The mounting and thermal block evaporator 502B may be made of a copper sheet with a thickness of about 1 to 5 mm, but other materials and thicknesses may be used as well. The back surface of the mounting and thermal block evaporator 502B is treated to be hydrophilic. It can spread the heat from the approximately 1 $mm^2$ area of the LED chip 501B to a relatively larger evaporating area (about 1 to 2 $cm^2$).

In both kinds of evaporator structures (FIGS. 5A and 5B), the evaporator is a part of a 3-D enclosure that encloses the chamber 410. In some embodiments, the mounting block 502A and the mounting and thermal block 502B can be made integrally with the fin structure 405. For convenient, both types of structures shown in FIGS. 5A and 5B are referred to as evaporators.

The L-V PCM, which is preferably a liquid at room temperature, is placed inside an L-V PCM reservoir 404, which is located near the evaporator surface in the example shown in FIG. 4. Different methods, including gravitational force, capillary force, and pumping methods can be used to spread the liquid from the reservoir 404 and constantly form a thin layer of liquid 403 on the evaporator surfaces. As mentioned earlier, the upper side of the mounting block 502A/502B and chip 501A has a hydrophilic surface; additional wick structure or fiber materials can be implemented to transport the L-V PCMs from the reservoir 404 to the evaporator surface by capillary action.

During operation, as the evaporator surface temperature rises, which can exceed the boiling temperature of the L-V PCM, the thin liquid layer evaporates to carry away the heat from the evaporator surface. The vapor fills the chamber 410 and the hollow space inside the fins of the fin structure, and condenses back into a liquid on the cold inside surfaces of the 3-D enclosure 405, transferring the heat to the cold surface.

Figure 6A:
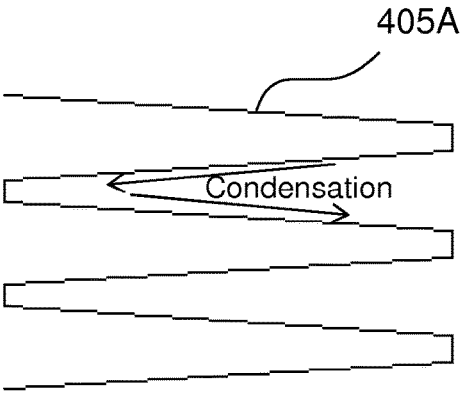
FIGS. 6A and 6B are schematic illustrations of details of a portion of a cooling structure in two variations of the embodiment of FIG. 4.
Figure 6B:
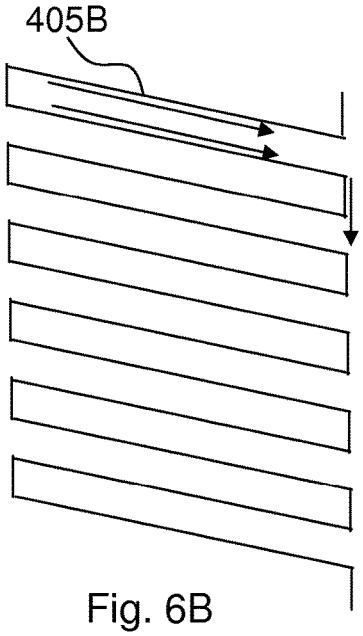

In FIG. 4, the up and down pointing arrows schematically indicates the general moving directions of evaporation and condensation, respectively. Various methods can be used to return the condensed liquid back to the reservoir to continuously form the thin liquid layer on the evaporator surface. In one design, shown in FIG. 6A (cross-sectional view of a part of the fin structure), the fins 405A of the fin structure have a tapered shape such that the inside surfaces of the hollow space of the fins are not horizontal. The taper angle may be, for example, 5-15 degrees from horizontal. This structure helps the condensed liquid to flow or drip down under gravity (as schematically indicated by the arrows) to return to the reservoir 404 and the evaporator surface. In another example, shown in FIG. 6B, the fins 405B are still parallel to each other in the cross-sectional view, but the fins tilt upwards as they extend outwards from the chamber. The tilt angle may be, for example, 5-15 degrees from horizontal. The liquid can flow downwards and drip down from the inner circular edge of each fin (as schematically indicated by the arrows) to return to the reservoir 404 and the evaporator surface.

The LED light shown in the embodiment of FIG. 4 (as well as those shown in FIGS. 7-11) is intended to be used in the orientation as shown, i.e., the mechanical and electrical connector 407 is located at the top and can be screwed into a conventional light fixture, while the LED chips 401 are located at a lower part and the light is projected downward though a transparent light cover 402 which faces downward. Modifications are needed if the LED light is intended to be used in other orientations, e.g., with the light projecting upwards or laterally to the side. In such cases, the evaporator surfaces (LED chips or mounting block) will not be located at the bottom of the chamber, but at the top or elsewhere.

Therefore, a wick structure will be needed to transport the liquid L-V PCM from the bottom of the chamber to the evaporator surfaces. The power unit 406 containing circuitry for driving the LED chips can be located at any suitable location.

As seen above, a phase change thermal exchange method is used as a thermal transformer to match thermal impedance of a small area of the chip evaporator (FIG. 5A) or mounting and thermal block evaporator (FIG. 5B) and the large arrears of the convection cooled surfaces of the 3-D enclosure 405 without any solid or liquid connections. Since the heat exchange coefficient of evaporation is large enough to transfer the heat without significant temperature rise from an approximately 1 $cm^2$ area to a much larger area of the 3-D enclosure 405, and conventional air/liquid convection methods are sufficient to dissipate the heat from the large areas of 3-D enclosure 405 without significant temperature rise above the environmental temperature, the total temperature difference between the LED device junction and the environment where the heat is dissipated into is small.

Figure 7:
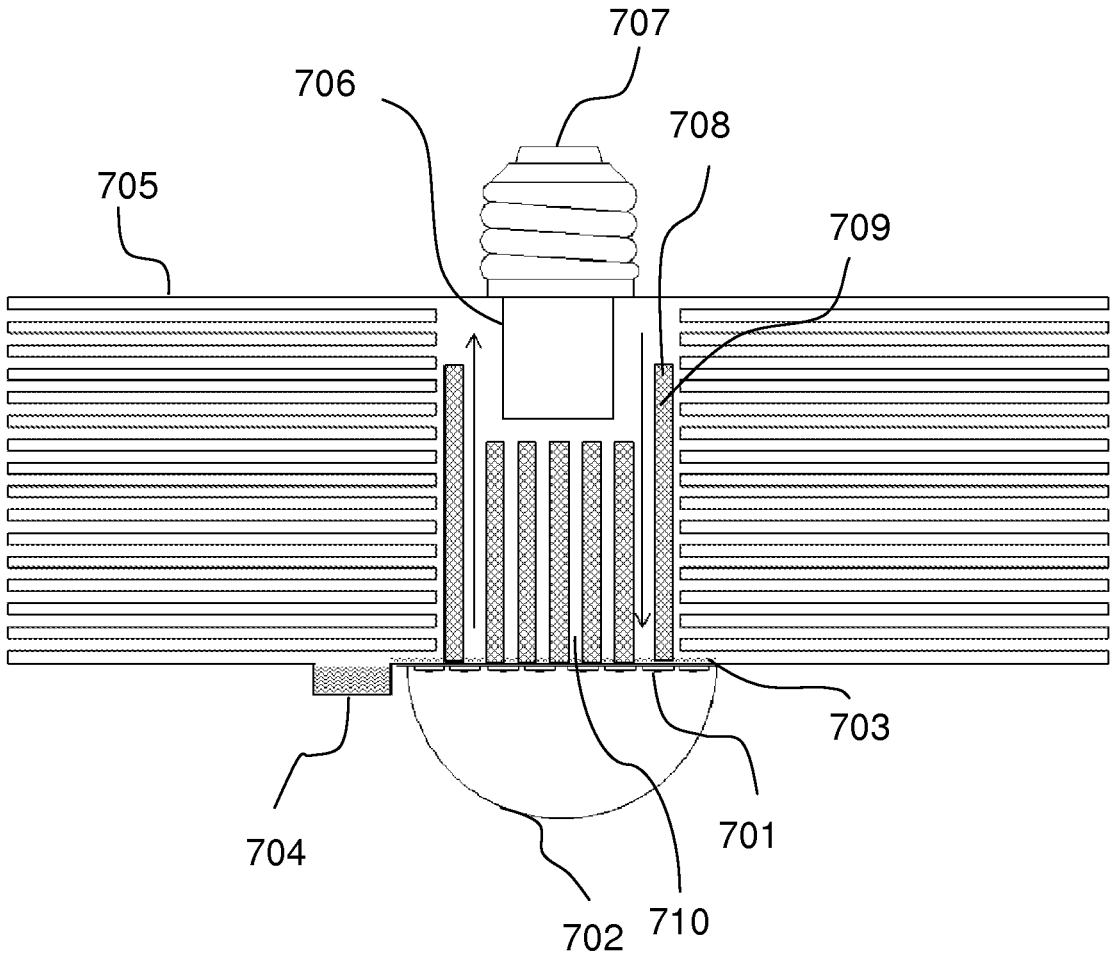
FIG. 7 is a schematic illustration of an LED luminaire with a cooling structure according to a second embodiment of the present invention.
Figure 8:
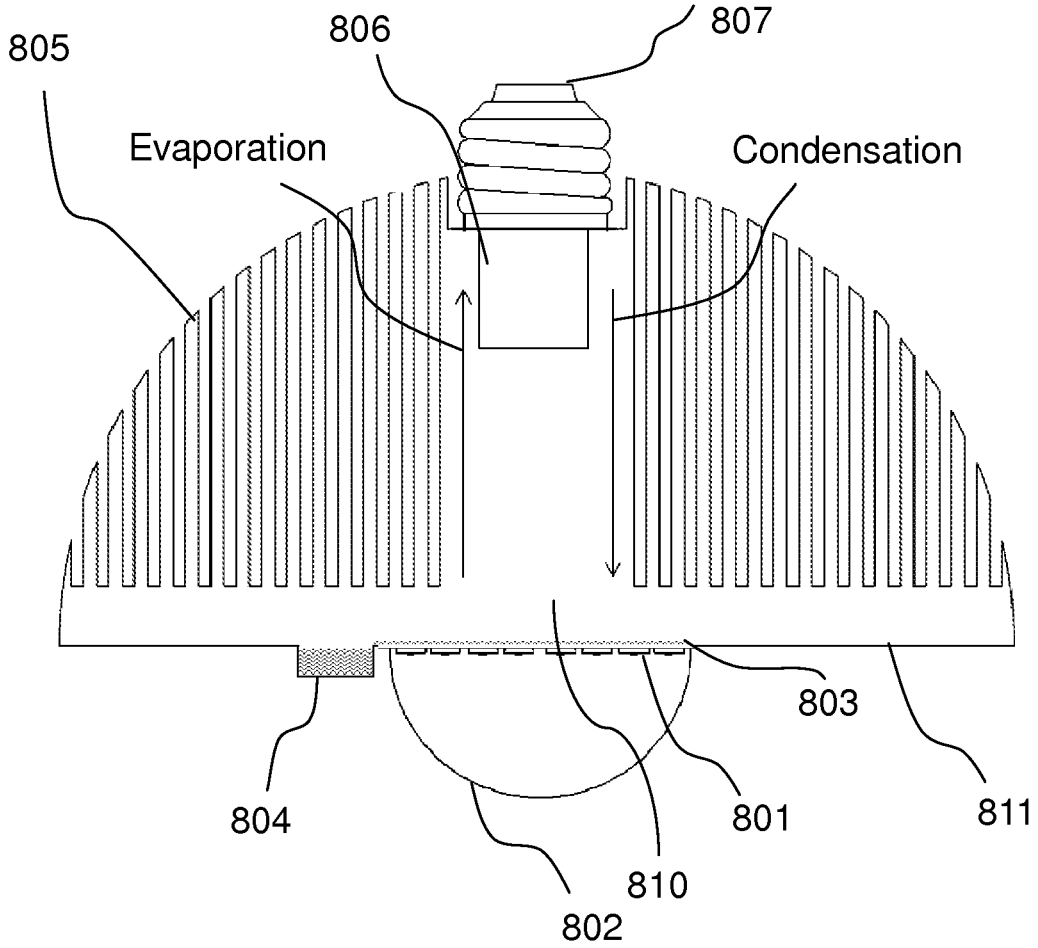
FIG. 8 is a schematic illustration of an LED luminaire with a cooling structure according to a third embodiment of the present invention.
Figure 9:
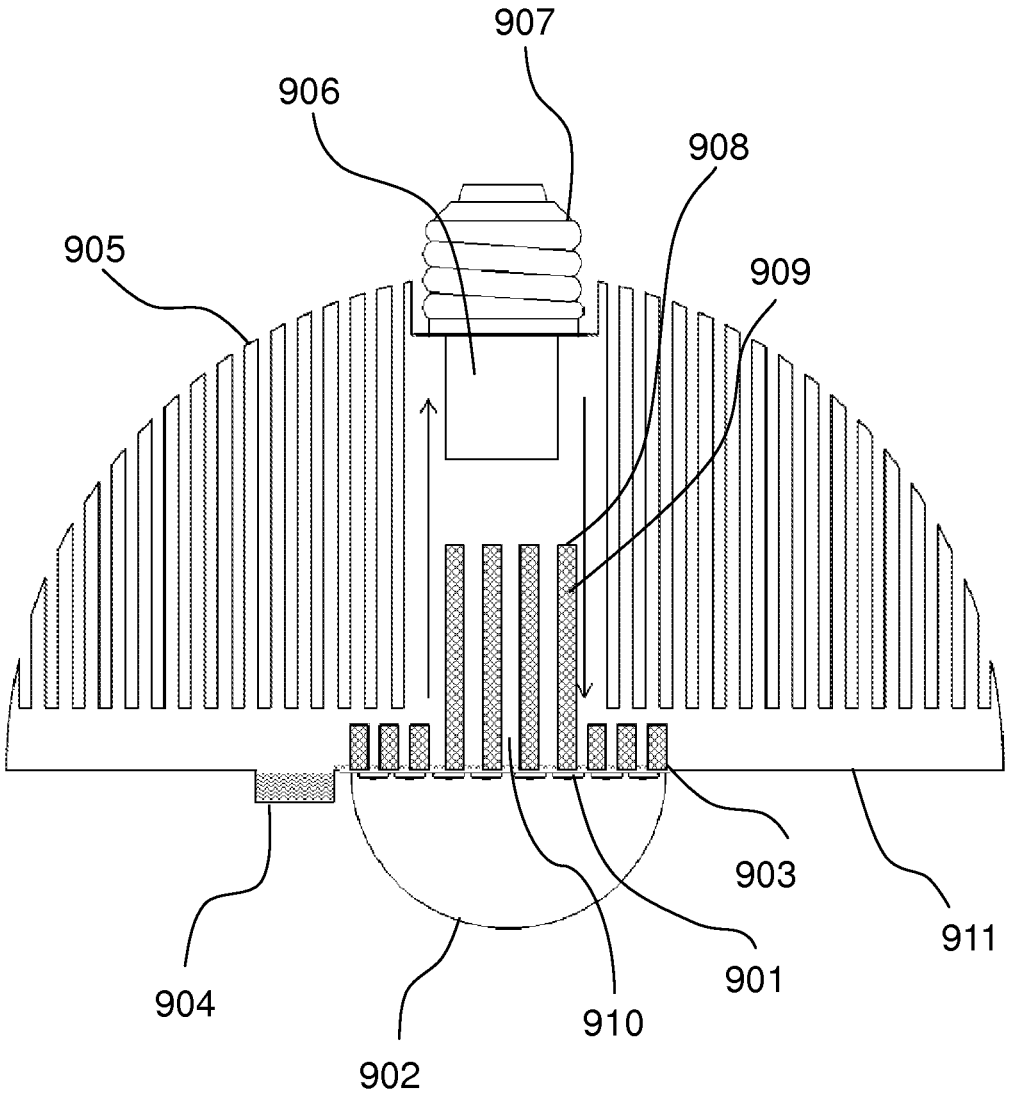
FIG. 9 is a schematic illustration of an LED luminaire with a cooling structure according to a fourth embodiment of the present invention.
Figure 10:
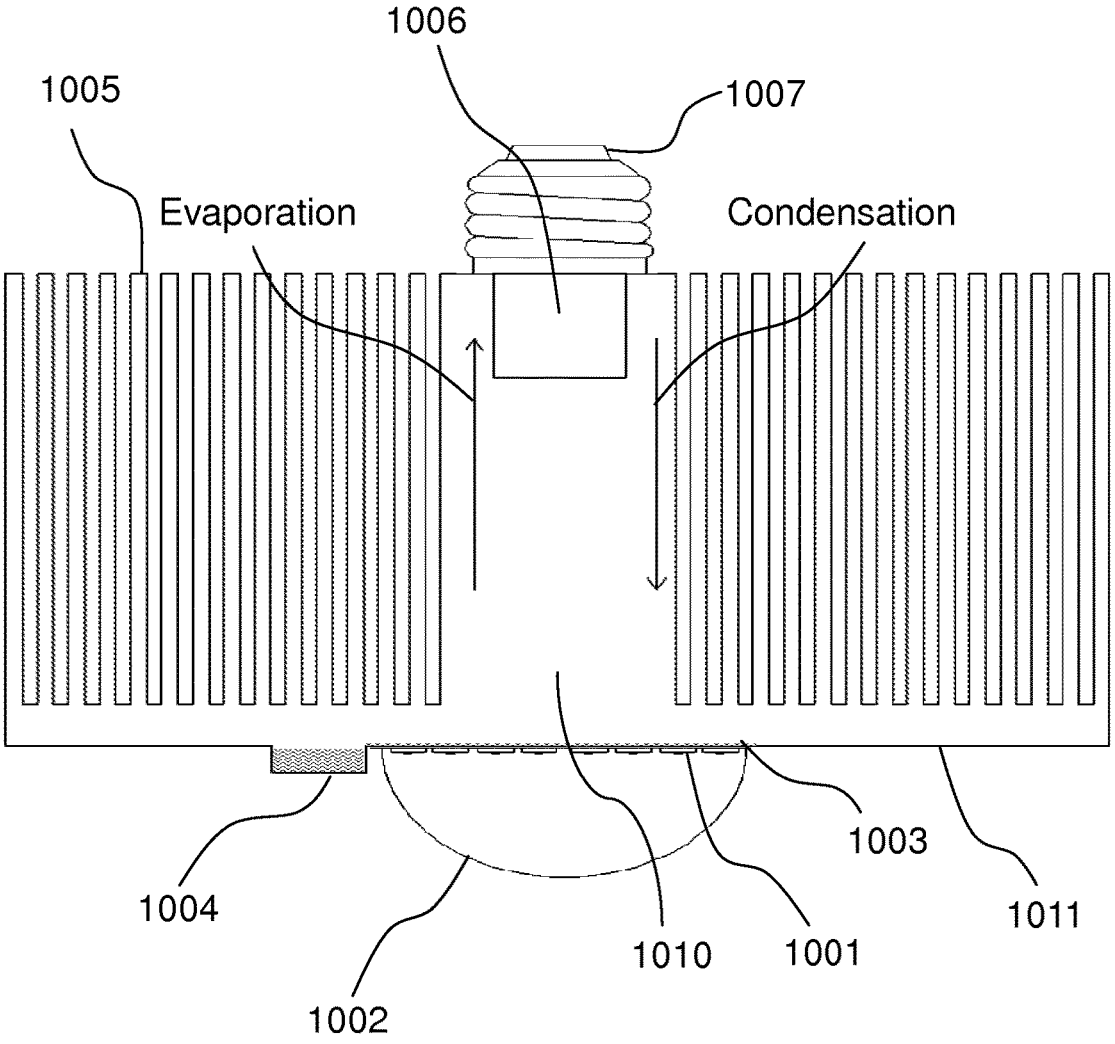
FIG. 10 is a schematic illustration of an LED luminaire with a cooling structure according to a fifth embodiment of the present invention.
Figure 11:
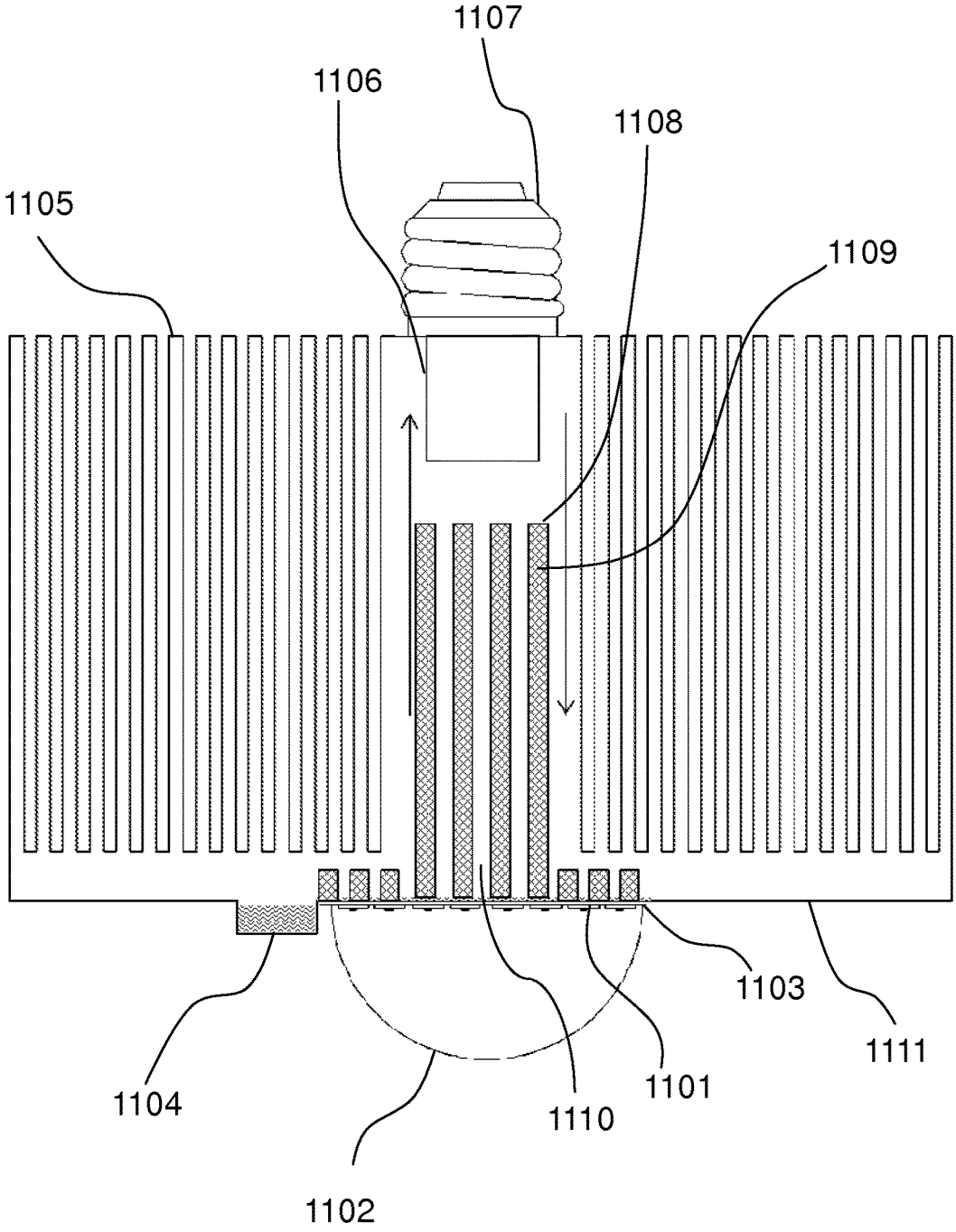
FIG. 11 is a schematic illustration of an LED luminaire with a cooling structure according to a sixth embodiment of the present invention.

An LED light according to a second embodiment of the present invention is illustrated in FIG. 7. This structure is useful in the situation that the temperature of the environment is higher than the desired operating temperature of the LED chip during the light operation. This structure is similar to that shown in FIG. 4, where like components are indicated by like symbols: LED chips 701, light cover 702, L-V PCM 703, L-V PCM reservoir 704, fin structure (3-D enclosure) 705, power unit 706, and mechanical and electrical connector 707. In addition, multiple containers 708 containing a solid to liquid phase change material (S-L PCM) 709 are provided in the interior space 710 of the LED light. During operation, the heat is transferred by the L-V PCM 703 from the evaporation surfaces (LED chip or the mounting block) to the surface of containers 708 where it condenses. When the S-L PCM temperature increases to the melting temperature of the S-L PCM, it melts to absorb the heat. Thus, the temperature of the evaporation surface (the LED chips or the mounting block) can be kept nearly constant at slightly above the melting temperature of the S-L PCM 709. The S-L PCM 709 is selected to have a melting temperature near (slightly lower than) the maximum desired operating temperature of the LED chip.

The S-L PCM containers 708 preferably have small sizes and are shaped as plates or cylinders to increase the contact area between them and the L-V PCM vapor. They can be placed inside the interior space 710 of the LED light as shown in FIG. 7, where the plates or cylinders are arranged vertically so that condensed liquid falls down back to the evaporator and the reservoir. Or they can be placed inside a different storage enclosure which is connected to the interior space 710 through a vapor piping via which L-V PCM vapor flows from the interior space 710 to the second enclosure and by a liquid piping via which the condensed liquid of the L-V PCM flows back to the interior space 710. Suitable structures may be used to cycle the liquid and vapor between the two enclosures.

Using this structure, when the environmental temperature is higher than the melting temperature of the S-L PCM, the heat generated by the LED chips during operation is temporarily stored inside the S-L PCM, and then dissipated into the environment when the environmental temperature drops down during the night.

Four LED lights according to third to sixth embodiments of the present invention are shown in FIGS. 8 to 11, respectively. The third embodiment (FIG. 8) and the fifth embodiment (FIG. 10) are modifications of the first embodiment (FIG. 4). The fourth embodiment (FIG. 9) and the sixth embodiment (FIG. 11) are modifications of the second embodiment (FIG. 7). Like components are labeled with like symbols and they are not enumerated here. In the first (FIG. 4) and second (FIG. 7) embodiments, the hollow fins in the fin structures 405/705 are substantially horizontal structures when the lights are oriented in the way they are intended to be used (the term substantially horizontal allows for the taper and/or tilt shown in FIGS. 6A and 6B). For example, each fin may be shaped as an annular disk disposed substantially horizontally parallel to the evaporator surface. In the third to sixth embodiments, the hollow fins of the fin structure 805/905/1005/1105 are substantially vertical structures when the lights are oriented in the way they are intended to be used. For example, the fins may be shaped as concentric nested tubes disposed perpendicular to the evaporator surface, or they may be flat plates disposed in parallel with each other and perpendicular to the evaporator surface. The cycling of the L-V PCM by gravitational mechanism in these embodiments is more convenient because of their vertical hollow fins. In addition, the bottom side of the enclosure 811/911/1011/1111 located under the fins can be slightly slanted toward the center to help the condensed liquid flow into the reservoir 804/904/1004/1104 and the evaporator surface.

The different overall geometries of the fin structures (3-D enclosures) 805/905/1005/1105 shown in FIGS. 8-11 are suitable for various application environments. The overall shape of the fin structure in the third (FIG. 8) and fourth (FIG. 9) embodiments is a dome, i.e., the outer fins are shorter than the inner fins, while the overall shape of the fin structure in the fifth (FIG. 10) and sixth (FIG. 11) embodiments is a cylinder. i.e., the fins have the same height.

Figure 3:
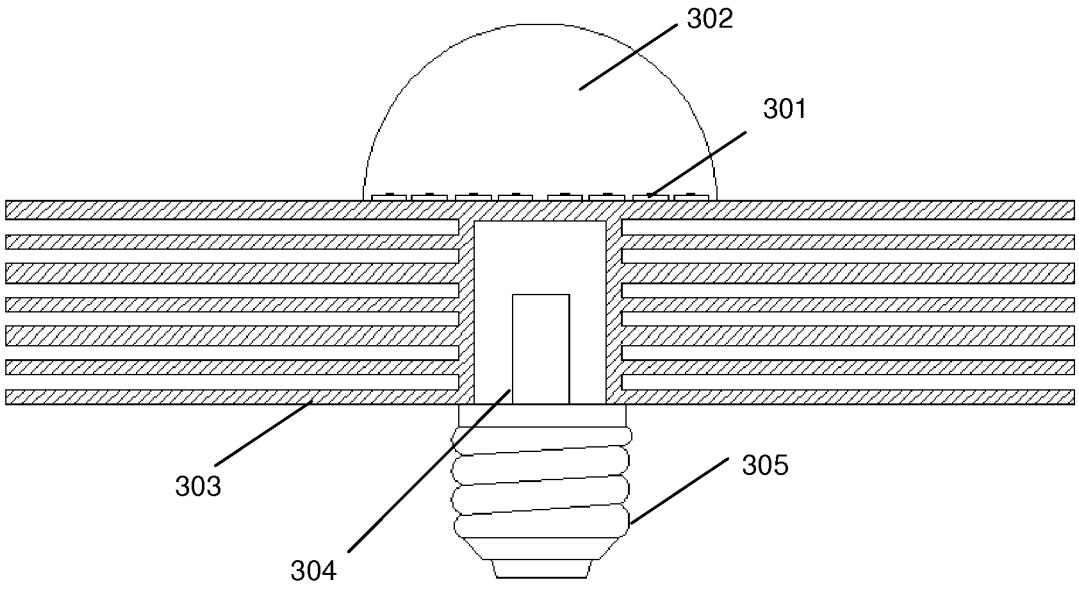
FIG. 3 schematically illustrates a conventional cooling mechanism for an LED luminaire.

In the above embodiments, the fins of the fin structures are hollow inside. One advantage of such a structure, compared so the structure with solid fins such as that shown in FIG. 3, is that it promotes transfer of heat to the surface of the fins because the vapor of the L-V PCM can enter the hollow space inside the fins. Another advantage is that it reduces the amount of material (typically metal, e.g. aluminum) that needs to be used to make the fin structure. In the conventional structure shown in FIG. 3, the fins 303 need to have a certain thickness to allow sufficient heat conduction from the base of the fins to the tip of the fins; therefore, a certain amount of material (metal) is required. In the hollow fin structure of the present embodiments, the thickness of the metal sheets of the hollow fins can be as thin as the mechanical strength of the fins will allow, because the heat only needs to be conducted from the inside surface of the fins to the outside surface and does not need to be conducted laterally from the base to the tip of the fins. This reduces the amount of materials required to make the fin structure, and therefore saving material cost and weight.

Figure 12:
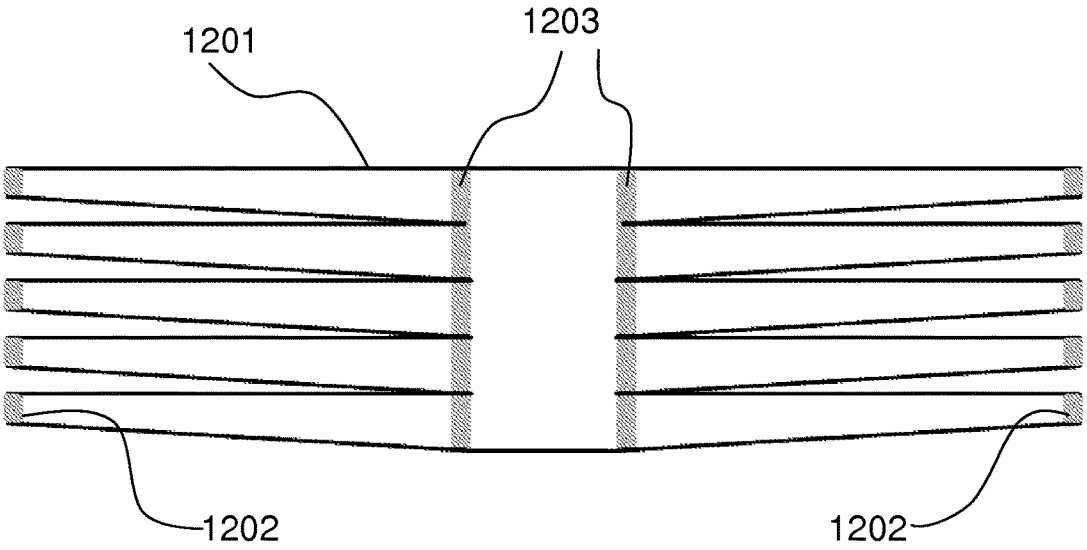
FIG. 12 schematically illustrates a structure and fabrication method of a 3-D enclosure of the cooling structure that can be used in various embodiments of the present invention.
Figure 12A:
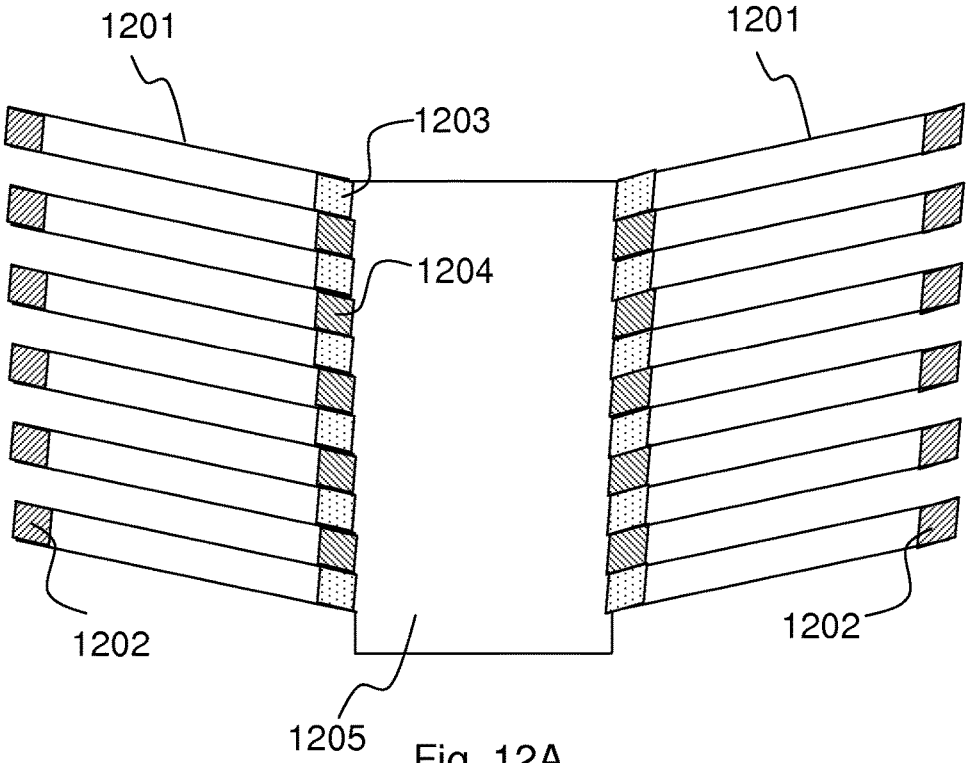

An example of a manufacturing process for the 3-D vacuum-sealed enclosure 405/705 of the first and second embodiment is schematically shown in FIGS. 12 and 12A. The fin structure is made of thin metal (e.g. aluminum) sheets 1201 formed into required shapes and joined together by a joining structure. To form the fin structure shown in FIGS. 4 and 7, where the fins are horizontal, the metal sheets are made into a flat annular ring shape. To form the tapered or tilted fin structures shown in FIGS. 6A and 6B, the metal plates are made into shallow truncated cone shapes. The metal plates can be made into other suitable shapes depending on the shaped of the fins.

As shown in FIGS. 12 and 12A, the joining structure includes inner rings 1203, 1204 and outer rings 1202 which are preferably made of plastic. The outer periphery of every other sheet 1201 (e.g., the first, third, fifth, etc.) is sealed to the outer periphery of the sheet under it by an outer sealing ring 1202, and the space between such pair of sheets will form the hollow space of the hollow fins. The inner rings 1203, 1204 are interleaved between the sheets at their inner peripheries, forming a stack. The inner rings 1204 which are disposed between two sheets 1201 whose outer peripheries are not sealed together are sealing rings that seal the respective inner peripheries together. The inner rings 1203 which are disposed between two sheets 1201 whose outer peripheries are sealed together are support rings for providing mechanical support to the stack of sheets, and they have openings on them to allow vapor and liquid to flow between the hollow space of the fins and the interior chamber 1205. Note that in FIG. 12, the inner peripheries of pairs of adjacent sheets whose outer peripheries are not sealed together are joined directly to each other without the support rings 1204. The rings 1202, 1203 and 1204 may be adhered to the sheets 1201 using a suitable adhesive material.

The fin structure can be assembled by sequentially placing the sheets and the outer and/or inner rings on top of each other and adhering them together to form a stack. Compared to forming the entire fins structure form a metal, the above manufacturing method is more cost effective without compromising the heat dissipation performance.

The fin structures in the third to sixth embodiments (FIGS. 8-11) can be formed in a similar manner, using a nested set of cylindrical shaped metal sheets of different diameters and sealing them together with plastic rings at appropriate locations at upped edges and lower edges of the tubes. A pair of adjacent cylindrical sheets sealed together by a sealing ring at their upper edges will form a fin with a hollow space inside, and adjacent fins are sealed to each other by sealing rings located at their lower edges.

To summarize, in traditional heat pipes or vapor chambers, the main material is copper. This leads to the high costs of the traditional heat pipes or vapor chambers. In embodiments of the present invention, aluminum sheets can be sealed successfully by using plastic rings. Because aluminum is a relatively cheap materials and because of the hollow structures, the estimated cost of such 3-D enclosures for the high power LEDs can be as low as 0.5 to 1.5 dollars. Comparing with solid heat sinks or 1-D/2-D heat pipes coupled with solid heat sinks, the 3-D enclosure according to embodiments of the present invention achieves a relatively low cost and a much better thermal matching performance.

It is understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A light emitting diode (LED) light comprising:

an enclosure structure defining a chamber, wherein the enclosure structure includes a plurality of hollow fins disposed in parallel with each other, each fin enclosing a hollow space which is connected to the chamber, the hollow spaces and the chamber forming a sealed space, wherein a part of the enclosure structure forms an evaporator, a plurality of LED chips mounted on the evaporator and in direct thermal contact with the evaporator;

a liquid to vapor phase change material (L-V PCM) disposed inside the chamber; and a plurality of containers disposed in the chamber, each containing a solid to liquid phase change material (S-L PCM) which is a different material from the liquid to vapor phase change material, wherein the L-V PCM is disposed in direct thermal contact with both the evaporator and exterior surfaces of the plurality of containers to transfer heat from the evaporator to the L-V PCM within the containers.

2. The LED light of claim 1, further comprising:

a reservoir disposed adjacent to the evaporator for holding the L-V PCM when it is in a liquid form; and a wick structure or fiber materials for transporting the L-V PCM from the reservoir to an inside surface of the evaporator by capillary action, wherein the inside surface of the evaporator is hydrophilic.

3. The LED light of claim 1, wherein the evaporator is a metal plate and the LED chips are mounted on an outside surface of the metal plate.

4. The LED light of claim 1, wherein the evaporator includes a plate with a plurality of openings, wherein the LED chips are mounted in the openings and a back side of each LED chip faces the chamber.

5. The LED light of claim 1, further comprising:

a connector for mechanically and electrically connecting the LED light to a lighting fixture;

a power unit having circuitry for driving the LED chips; and a transparent cover disposed over the LED chips.

6. The LED light of claim 1, wherein the fins are shaped as flat or curved annular plates and disposed parallel to an inside surface of the evaporator.

7. The LED light of claim 6, wherein each fin includes two annular shaped metal sheets disposed in parallel with each other and an outer plastic sealing ring sealing outer peripheries of the two metal sheets together, and wherein adjacent fins are joined to each other by inner plastic sealing rings located at inner peripheries of the metal sheets.

8. The LED light of claim 1, wherein the fins are disposed perpendicular to an inside surface of the evaporator.

9. The LED light of claim 8, wherein each fin includes two nested cylindrical shaped metal sheets of different diameters and an upper plastic sealing ring sealing upper edges of the two metal sheets together, and wherein adjacent fins are joined to each other by lower plastic sealing rings located at lower edges of the metal sheets.

* * * * *